US005163199A

United States Patent [19]

Saja et al.

[11] Patent Number: 5,163,199

[45] Date of Patent: Nov. 17, 1992

[54] MULTIPLE OPERATING HEAD APPARATUS FOR CLEANING METAL PIECES

[76] Inventors: Antonio Saja; Roberto Rizzo, both of Via Fratelli Bandiera, 9/11, 20056 - Trezzo Sull'Adda Milano, Italy

[21] Appl. No.: 700,562

[22] Filed: May 15, 1991

[30] Foreign Application Priority Data

May 24, 1990 [IT] Italy ..... 21249/90[U]

[51] Int. Cl.[5] ..... A46B 13/02

[52] U.S. Cl. ..... 15/88.4; 15/97.1; 15/88.3; 51/99

[58] Field of Search ..... 15/88.4, 88.3, 88.2, 15/97.1, 88, 77; 51/99, 168, 169; 29/81.12, 81.05, 90.01

[56] References Cited

U.S. PATENT DOCUMENTS

| | | | |
|---|---|---|---|
| 1,290,659 | 1/1919 | Rehm | 51/99 |
| 4,502,251 | 3/1985 | Everett | 51/99 |
| 4,589,158 | 5/1986 | Sheldon | 15/88.3 |

*Primary Examiner*—Edward L. Roberts
*Attorney, Agent, or Firm*—Bucknam and Archer

[57] ABSTRACT

An apparatus for cleaning metal pieces comprises, on a supporting framework, a plurality of cleaning assemblies, each of which comprises two adjoining and independent operating arms, each of which supports one or more operating tools.

4 Claims, 5 Drawing Sheets

MULTIPLE OPERATING HEAD APPARATUS FOR CLEANING METAL PIECES

BACKGROUND OF THE INVENTION

The present invention relates to a multiple operating head apparatus for cleaning metal pieces.

As is known, for surface finishing metal pieces such as trays, pots, nick-nacks and the like, there are conventionally used cleaning apparatus which comprise three cleaning assemblies which can be remotely independently controlled, and which drive a specific operating or working tool corresponding to the type of surface finishing to be obtained.

These prior cleaning apparatus provide, in each cleaning assembly, a single operating tool, with the consequent need of frequently replacing the operating tool, depending on the different type of surface finishing to be made.

SUMMARY OF THE INVENTION

Accordingly, the aim of the present invention is to solve the thereinabove mentioned problem, by providing an apparatus for cleaning metal pieces in general, including a plurality of operating heads, with a plurality of working tools, operating at the same cleaning station or region, thereby remarkably reducing the number of the tool replacement operations.

A further object of the present invention is to provide such a metal piece cleaning apparatus which is adapted to perfectly clean even pieces having a very complex profile.

Yet another object of the present invention is to provide such a metal piece cleaning apparatus which is very reliable in operation, and can be easily made starting from easily available materials and elements and which, moreover, is very competitive from a mere economic standpoint.

According to one aspect of the present invention, the above mentioned objects, as well as yet other objectives, which will become more apparent hereinafter, are achieved by a multiple operating head apparatus for cleaning metal pieces, characterized in that said apparatus comprises a supporting framework supporting a plurality of metal piece cleaning assemblies, each of which is provided with two adjoining and independent operating arms, each of which supports at least an operating tool.

BRIEF DESCRIPTION OF THE DRAWINGS

Further characteristics and advantages of the invention will become more apparent hereinafter from the following detailed disclosure of an apparatus for cleaning metal pieces, provided with a plurality of operating heads, and which is illustrated, by way of a merely indicative but not limitative example, in the figures of the accompanying drawings, where.

DESCRIPTION OF THE PREFERRED EMBODIMENTS

Figure 1:
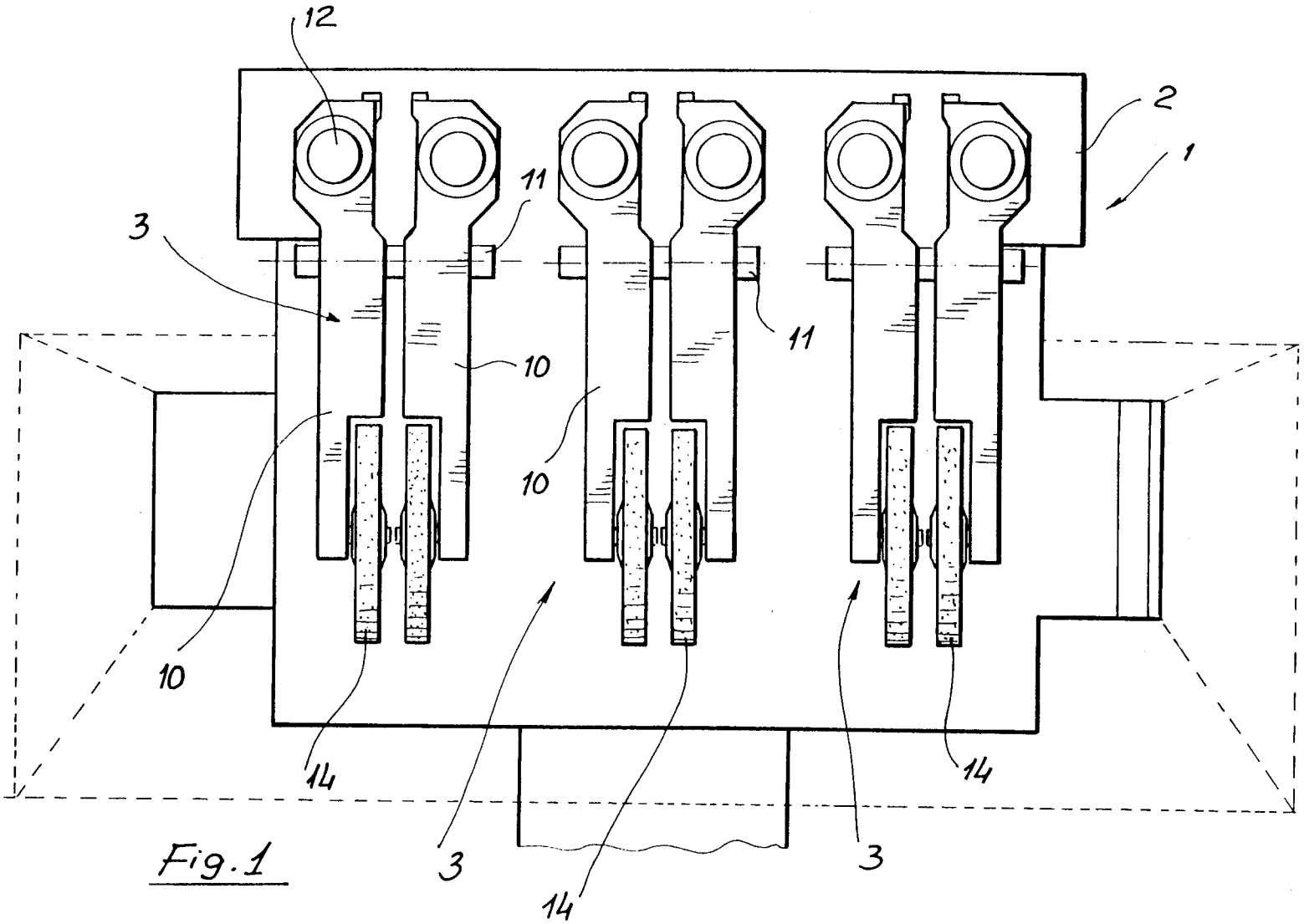
FIG. 1 is a schematic top plan view of the cleaning apparatus according to the invention.
Figure 2:
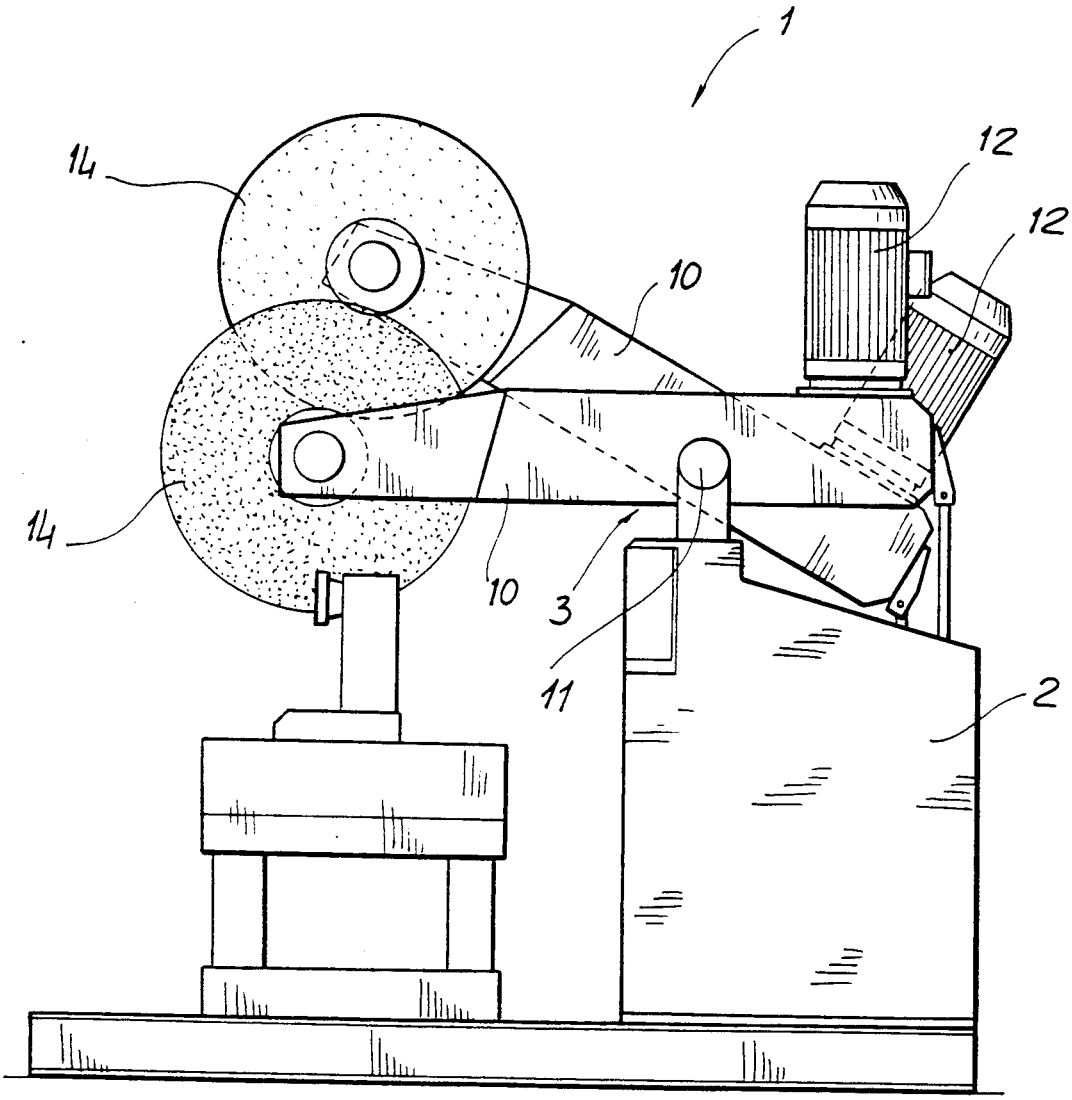
FIG. 2 is a side elevation view of the subject cleaning apparatus.
Figure 3:
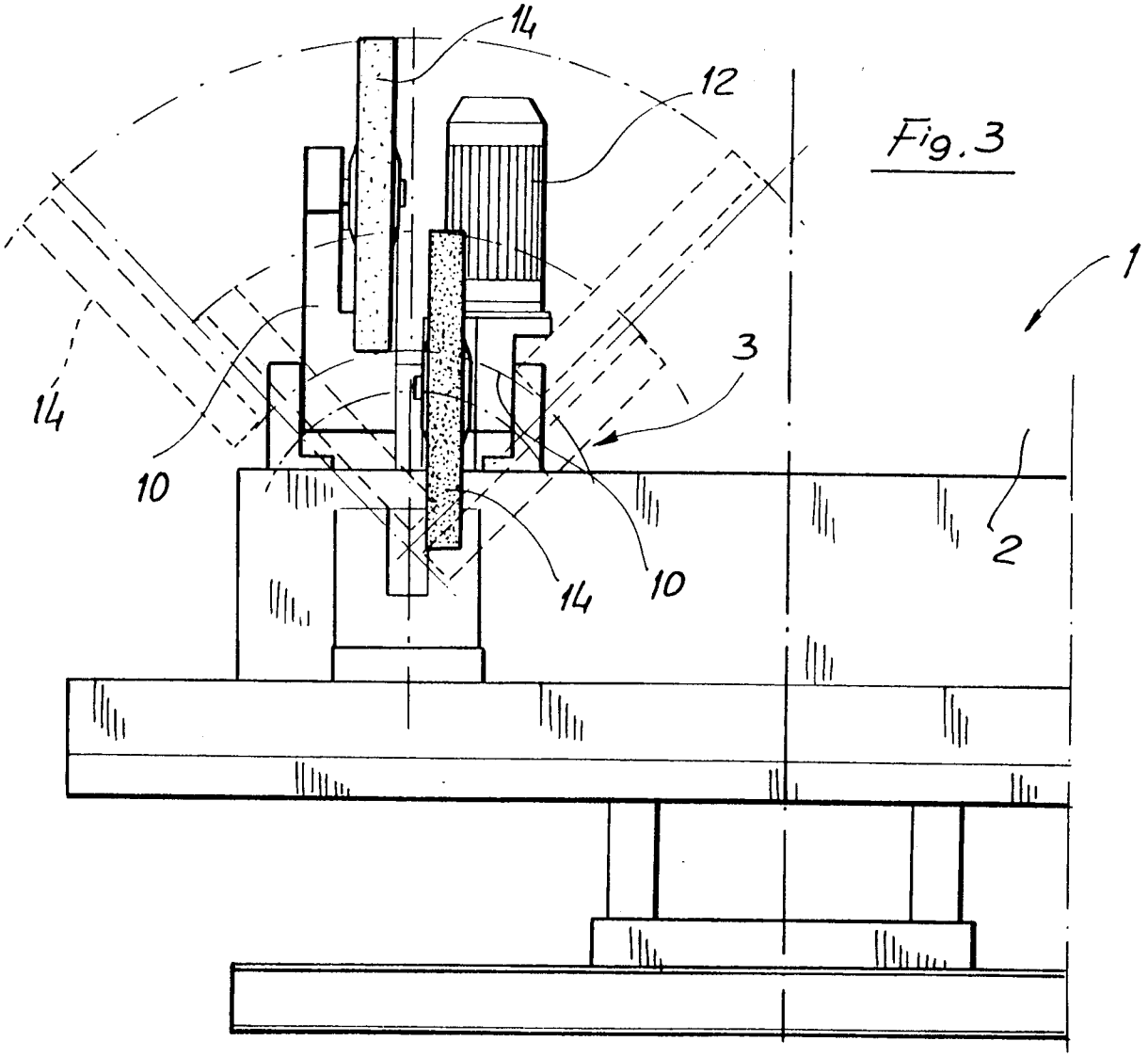
FIG. 3 is a front elevation view of the subject cleaning apparatus.

With reference to the figures of the accompanying drawings, the multiple operating head cleaning apparatus for cleaning metal pieces according to the present invention, which is overally indicated at the reference number 1, comprises a supporting framework 2, thereon there are arranged a plurality of cleaning assemblies 3, which, in the embodiment being disclosed, are three in number.

Each cleaning assembly 3 comprises two adjoining arms 10, pivoted at 11, at an intermedie portion thereof, and supporting, at one end portion thereof, a driving motor 12 and, at the other end portion thereof, operating tools 14.

Moreover, each cleaning assembly can swing about a horizontal axis, so as to change the tilting angle of the operating tool which, accordingly, can easily reach any desired points of the metal piece being cleaned.

According to a preferred embodiment, each cleaning assembly is provided with two operating tools or multiple heads, arranged with an adjoining and independent relationship, so as to enlarge the operating range of the finishing operation which can be performed on the metal piece, without the need of replacing the tools.

Figure 4:
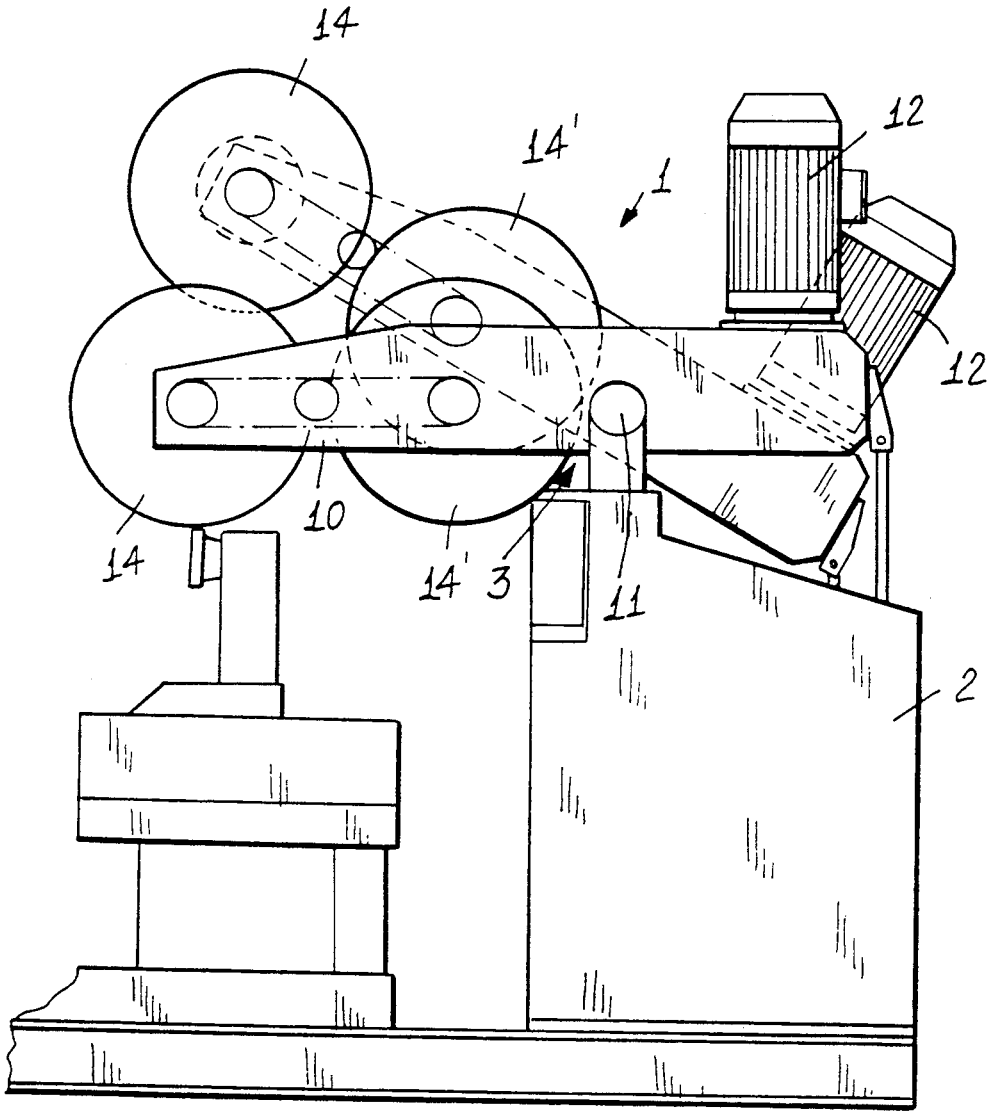
FIG. 4 shows an embodiment of the subject cleaning apparatus including a double tool which is adapted to swing about a central axis.

In the embodiment of the cleaning apparatus shown in FIG. 4, the apparatus comprises a plurality of cleaning assemblies 3, each of which comprises two or more adjoining operating arms 10, pivoted at 11.

Each operating arm supports, at one end portion thereof, two or more operating tools 14 and 14' which can swing about a central axis 11.

Figure 5:
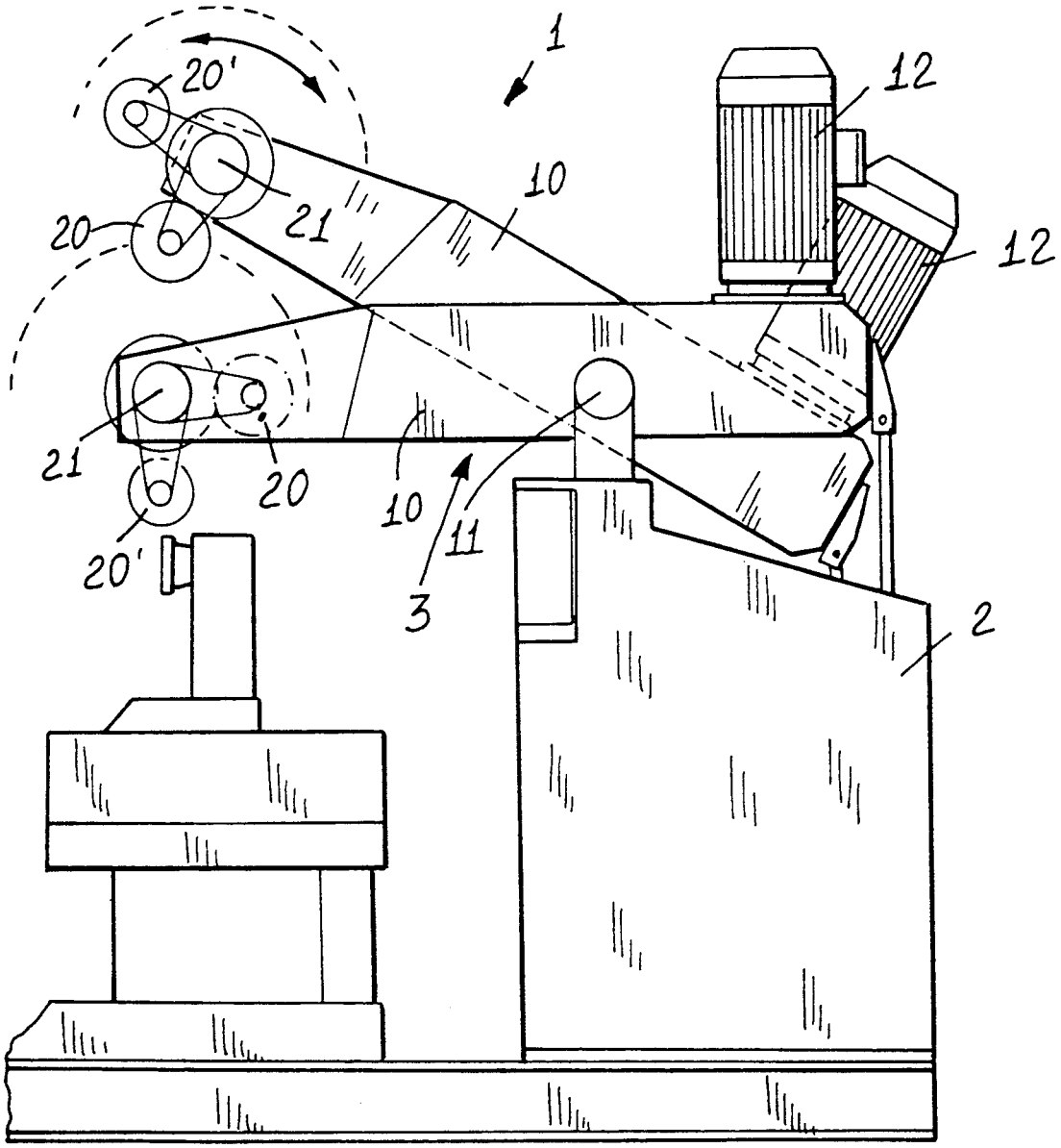
FIG. 5 shows another embodiment of the multiple operating head cleaning apparatus according to the invention.

In the embodiment shown in FIG. 5, the cleaning apparatus is provided with pairs of arms 10 supporting a plurality of tools 20 and 20' which can rotate about a pivot pin 21.

From the above disclosure it should be apparent that the invention fully achieves the intended objects.

While the invention has been disclosed and illustrated with reference to preferred embodiments thereof, it should be apparent that the disclosed embodiments are susceptible to many modifications and variations all of which will come within the spirit and scope of the appended claims.

We claim:

1. A multiple operating head apparatus for cleaning metal pieces, characterized in that said apparatus comprises a supporting framework supporting a plurality of metal piece cleaning assemblies, each of which is provided with two adjoining and independent operating arms, each of which supports at least an operating tool.

2. A cleaning apparatus according to claim 1, wherein said arms are pivoted at an intermediate portion thereof to said supporting framework.

3. A cleaning apparatus according to claim 1, wherein said arms support, at an end portion thereof, the operating tools and, at another end portion thereof, an operating motor.

4. A cleaning apparatus according to claim 1, wherein said arms can swing about a substantial horizontal axis, in order to set said operating tools at a given operating angle.

* * * * *